US007036344B2

(12) United States Patent
Gast et al.

(10) Patent No.: US 7,036,344 B2
(45) **Date of Patent: *May 2, 2006**

(54) PADLOCK

(75) Inventors: Robert Lee Gast, Foothill Ranch, CA (US); John Wade Landrum, Foothill Ranch, CA (US); Robert A. Wilkosz, Foothill Ranch, CA (US); Loring M. Johnson, Tinley Park, IL (US)

(73) Assignee: Hampton Products International Corporation, Foothill Rach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/891,830

(22) Filed: Jul. 15, 2004

(65) Prior Publication Data

US 2005/0061040 A1 Mar. 24, 2005

Related U.S. Application Data

(63) Continuation of application No. 10/251,680, filed on Sep. 20, 2002, now Pat. No. 6,766,673.

(60) Provisional application No. 60/324,217, filed on Sep. 21, 2001.

(51) Int. Cl.
*E05B 67/32* (2006.01)

(52) U.S. Cl. ..... 70/38 A; 70/26; 70/38 R; 70/39

(58) Field of Classification Search ..... 70/38 A, 70/38 B, 20, 26, 39, 35, 38 R
See application file for complete search history.

(56) References Cited

U.S. PATENT DOCUMENTS

| | | | | |
|---|---|---|---|---|
| 1,636,381 | A * | 7/1927 | Megie et al. | 70/38 B |
| 2,460,615 | A * | 2/1949 | Andrew | 70/38 A |
| 2,691,288 | A * | 10/1954 | Childs | 70/38 A |
| 3,835,675 | A | 9/1974 | Lippisch | |
| 3,952,565 | A | 4/1976 | Falk | |
| 4,138,868 | A | 2/1979 | Richards, Sr. | |
| 4,158,952 | A | 6/1979 | Oliver et al. | |
| 4,528,828 | A | 7/1985 | Poutiainen | |
| 4,545,223 | A | 10/1985 | Poutiainen | |
| 4,998,422 | A * | 3/1991 | Borgmann et al. | 70/38 A |
| 5,174,136 | A * | 12/1992 | Thwing | 70/38 A |
| 5,377,511 | A | 1/1995 | Meckbach | |
| 5,394,711 | A | 3/1995 | Pitkänen | |
| 6,101,852 | A | 8/2000 | Steinbach | |
| 6,393,876 | B1 * | 5/2002 | Matyko | 70/38 A |
| 6,766,673 | B1 * | 7/2004 | Gast et al. | 70/38 A |
| 6,813,913 | B1 * | 11/2004 | Watts | 70/38 A |

* cited by examiner

*Primary Examiner*—Brian E. Glessner
*Assistant Examiner*—Christopher Boswell
(74) *Attorney, Agent, or Firm*—William G. Lane

(57) ABSTRACT

An improved padlock having a shackle retainer assembly that can be removed without removal of the padlock key locking assembly and/or convertible from a key retaining to a key nonretaining lock, or vice versa, by removal or insertion of a pin on the driver end of the key cylinder assembly.

16 Claims, 12 Drawing Sheets

PADLOCK

This application is a continuation of U.S. patent application Ser. No. 10/251,680, filed Sep. 20, 2002 now U.S. Pat. No. 6,766,673, and claims the benefit of Provisional Application Ser. No. 60/324,217, filed on Sep. 21, 2001.

FIELD OF THE INVENTION

The present invention is an improved padlock having an improved shackle retainer assembly which greatly eases the replacement of a shackle in a lock. The present invention also is an improved padlock which can be easily converted from a key retaining lock to a key nonretaining lock and vice versa.

BACKGROUND OF THE INVENTION

Padlocks can have shackles of lengths from ½-inch up to and including 6 inches. Padlocks with even longer shackles, up to almost 20 inches have been prepared. For the lower grades of locks, the locks made with the shackle permanently secured to the lock body it is not possible to change shackles. This requires the locksmith, or store, or manufacturer to carry a large inventory of locks having different shackles. More expensive locks have replacement shackles which normally require at least removal of the locking assembly from the lock to change the shackle. Some locks require removal of a pin from the back of the body to change a shackle.

Some locks are normally made either to retain the key in the lock when the lock is unlocked or open or to permit the key to be removed when the lock is unopened or locked state. Expensive locks can be converted from key retaining to key nonretaining by replacing either the key cylinder assembly or the key cylinder plug, or for some locks, replacing an adapter positioned between the key cylinder assembly and the lock ball retainer.

The present invention provides a cylinder plug which permits the lock to be made key retaining by the insertion of a pin at the driver end of the cylinder plug, or made non-key retaining, i.e. key nonretaining, by removal of a pin from the driver end of the cylinder plug. By key retaining, it is meant that the lock retains the key in the cylinder assembly when the lock is in the unlocked state. By key nonretaining, i.e. non-key retaining, it is meant that the key can be removed from the lock in the unlocked state. By the unlocked state, it is meant that both arms of the shackle are not secured within the lock body by the locking mechanism.

SUMMARY OF THE INVENTION

The improved padlock of the present invention has a lock body with first and second shackle bores open to the top of the lock and extending toward the bottom of the body, a lock assembly chamber open to the bottom of the lock body and extending upwardly toward the top of the lock body, a lock ball bore extending from the top portion of the first shackle bore through the top of the lock assembly chamber into the top portion of the second shackle bore, and an access hole extending from the bottom of the lock body into the bottom of the second shackle bore; a generally U-shaped shackle having first and second arms, the first arm adapted to be slidably moved in and out of the first shackle bore and to be lockably engaged in the first shackle bore, the second arm slidably and rotably secured in the second shackle bore and adapted to be lockably engaged in the second shackle bore, the second arm having a threaded bore opening to its end, the first and second arms having notches facing each other to receive lock balls to lockably secure the shackle in the lock body, a torus-shaped retainer adapted to slide and rotate within the second shackle bore, a threaded retaining member having a recessed driver receiver hole in its head securing the retainer into the base of the second arm, the threaded retaining member adapted to be secured and removed from the end of the second arm of the shackle by a driver inserted through the access hole into the recessed driver receiver hole and threaded into or out of the threaded bore in the second arm, first and second lock balls adapted to slide in the lock ball bore to engage the notches in the first and second arms to lock the shackle in the lock body, a lock ball retainer at the top of the lock assembly chamber adapted to rotate therein, the lock ball retainer having a driven end, first and second notches to receive the first and second lock balls, respectively, to unlock the shackle from the lock body, and two lock ball races running between the first and second notches adapted to rollingly engage the lock balls and to push the lock balls into the notches of the first and second arms to lock the shackle in the lock body; a key cylinder assembly having a key cylinder housing and a key cylinder plug, the plug having a key insert end and opposing driver end, the driver end engaging the driven end of the lock ball retainer, the key cylinder plug, when rotated, rotating the lock ball retainer from a locked position to an unlocked position.

The improved padlock of the present invention has a lock body with first and second shackle bores open to the top of the lock body and extending toward the bottom of the body, a lock assembly chamber open to the bottom of the lock body and extending upwardly toward the top of the lock body, a lock ball bore extending from the top portion of the first shackle bore through the top of the lock assembly chamber into the top portion of the second shackle bore, and an access hole extending from the bottom of the lock body into the bottom of the second shackle bore; a generally U-shaped shackle having first and second arms, the first arm adapted to be slidably moved in and out of the first shackle bore and to be lockably engaged in the first shackle bore, the second arm slidably and rotably secured in the second shackle bore and adapted to be lockably engaged in the second shackle bore, the first and second arms having notches facing each other to receive lock balls to lockably secure the shackle in the lock body, first and second lock balls adapted to slide in the lock ball bore to engage the notches in the first and second arms to lock the shackle in the lock body, a lock ball retainer at the top of the lock assembly chamber adapted to rotate therein, the lock ball retainer having a driven end, first and second notches to receive the first and second lock balls, respectively, to unlock the shackle from the lock body, and two lock ball races running between the first and second notches adapted to rollingly engage the lock balls and to push the lock balls into the notches of the first and second arms to lock the shackle in the lock body; a key cylinder assembly having a key cylinder housing and a key cylinder plug, the key cylinder plug having a key insert end and an opposing driver end, the driver end engaging the driven end of the lock ball retainer, the cylinder plug when rotated rotating the lock ball retainer from a locked position to an unlocked position.

In another embodiment, the key cylinder assembly comprising a cylinder body and a cylinder plug which is mounted for rotation within the cylinder body, the cylinder plug having a key entry end to receive a bitted or cut key to rotate the cylinder plug and a driver end having a driver half-round in cross section with a straight driver face; a lock ball retainer mounted for rotation at the top of the lock assembly chamber, the lock ball retainer having two diametrically opposed notches on it cylindrical side and two lock ball races on its cylindrical side connecting the notches, the lock balls adapted the position within the notches when the lock is unlocked and the two balls adapted to rotate on the lock ball races when the lock is in a locked state, the lock ball retainer having on its driven end a quarter-round drive pedestal or step with two perpendicular drive surfaces, the driver surface of the cylinder plug adapted to engage the first drive surface of the lock ball retainer when the cylinder plug is rotated to unlock the lock and to align the notches; a retainer spring connected to the lock ball retainer to bias the retainer from an unlocked state to a locked state. In the unlocked state, the lock balls are free to roll into the lock ball retainer notches freeing the notches on the first and second shackle arm, unlocking the shackle and permitting the shackle to be elevated up from the lock body with the first arm clearing the lock body and the second arm being retained in the lock body for sliding up and down and rotation, the second arm urging the second lock ball into the second notch of the lock ball retainer until the shackle is inserted back into the lock body in a locked position permitting the lock ball to be received within the notch on the second arm, retention of the lock ball in the second notch of the lock ball retainer by the second arm preventing the retainer from rotating back to its locked position, but the key cylinder plug can freely rotate back to key insertion position to permit removal of the key. The driver end of the key cylinder plug having a hole spaced apart from the driver, a pin which can be seated in the hole. The pin adapted to engage the lock ball retainer step when the lock is in the unlocked state preventing a rotation of the cylinder plug back to the key insertion position, thus preventing removal of a key from the key cylinder plug when the lock is in unlocked condition. When the shackle is pushed into the lock body and the lock balls engage the notches in the two arms of the shackle, the lock ball retainer turns to its lock position with the lock balls engaging the lock ball races and the step driving the driver to rotate key lock plug to this key insertion position.

In another embodiment of the present invention, the driver end of the cylinder plug has a pin hole positioned away from the flat surface in the driver end; a pin removably seated in the pin hole, the pin engaging the step of the lock ball retainer which prevents rotation of the cylinder plug to its locked position or key insertion position when a rotating force is removed from the key in the cylinder plug slot to return the plug to its locked position so that the key may be removed.

The present invention is directed to a removable shackle for a padlock with a locking assembly, the shackle having a U-shape with parallel first and second arms, the second arm being longer than the first arm, the second arm having an end and being circular in cross section with a first diameter and having a longitudinal axis extending the length thereof, each arm toward its end having a notch adapted to cooperate with the locking assembly of the padlock for locking the shackle in the padlock, the second arm having a flat area extending between the notch and the end of the arm and a semicircular groove at the end of the arm extending from one side of the flat area to the other side of the flat area around the circumference of the arm; and a circular retainer of the first diameter detachably secured coaxially with the second arm at the end of the second arm.

The retainer can have a spring keeper extending axially downward from the retainer. Preferably the end of the second arm has a threaded hole, the retainer has a nonthreaded hole, and the retainer is detachably secured to the end of the second arm with a threaded screw passing through the nonthreaded hole of the retainer and received by the threaded hole in the second arm. The threaded screw can have a head with a socket to receive a driver to rotate the screw. The retainer can have a spring keeper extending axially downward from the retainer. The bottom of the spring keeper can have a recess adapted to receive the head of the threaded screw. The threaded screw can be sized to act as a spring keeper.

The present invention is also directed to an improved padlock with a removable shackle retainer assembly comprising: a lock body with first and second bores extending inwardly from the top of the body; a central cavity open to the bottom of the body and in communication with the first and second bores; a hole open to the bottom of the body and in communication with the second bore, the hole adapted to receive a socket driver; a shackle having a U-shape with first and second parallel arms, the first arm adapted to be received in and lockable in the first bore, the second arm adapted to be received in, lockable in, slidable in and out of, and rotatable in the second bore; a locking assembly in the central cavity adapted to lock the first and second arms in the bores; and a key cylinder assembly attachably connected to the locking assembly and adapted to actuate the locking assembly to lock the lock and to unlock the lock.

The padlock can include a compression spring positioned at the bottom of the second bore beneath the end of the second arm. The retainer can have a spring keeper extending downward adapted to engage the upper end of the spring.

The retainer is attached to the end of the second arm by a threaded screw. In this embodiment, the end of the second arm preferably has a threaded hole, the retainer has a nonthreaded hole, and the shackle includes a threaded screw adapted to be screwed in the threaded hole to secure the retainer to the end of the second arm. Preferably the threaded screw has a head with a socket to receive a driver to rotate the screw. The preferred socket is an Allen head socket. However other sockets, such as square drive sockets can be used. Sockets that receive the driver head and align the driver with threaded screw are preferred. If the retainer has a spring keeper, the spring keeper can have a coaxial recess to receive the head of the threaded screw. The threaded screw can be sized to act as a spring keeper.

Another embodiment of the present invention is an improved key cylinder assembly for padlocks comprising:

a key cylinder body having a bible, a key end and opposing driver end, and a cylindrical central cavity extending from the key end to the driver end of the key cylindrical body, the bible having channels with pins and springs, the channels in communication with the cylindrical central cavity, and a key cylinder plug having a key end and an opposing driver end and a circular surface, the key cylindrical plug adapted to be received in and rotated in the cylindrical central cavity, the key cylinder plug having a key slot extending from the key end to the driver end and dividing the key cylinder plug into first and second hemispheres, the key cylinder plug having channels with pins, the channels of the cylindrical plug being coaxial with the channels of the key cylinder body when the channels of the plug and the body are aligned, the channels of the plug communicating with the key slot, the key slot adapting to receive a bitted key which is adapted to align the ends of the pins in the channels with the circular surface of the plug to permit rotation of the plug in the cylindrical central cavity of the body, the driver end of the plug having a half-round driver extending axially outward from the driver end of the first hemisphere and a pin hole extending axially inward in the driver end of the second hemisphere. The key cylinder body can have a pin detachably received in the pin hole. Thus the pin 110 can be inserted into the pin hole 112 or removed from the hole.

Another embodiment of the present invention is an improved padlock comprising: a lock body with a first and second bores extending inwardly from the top of the body; a cavity open to the bottom of the body and in communication with the first and second bores; a shackle having a U-shape with first and second parallel arms, the first arm adapted to be received in and lockable in the first bore, the second arm adapted to be received in, lockable in, slidable in and out of, and rotatable in the second bore; a locking assembly within the central cavity for locking the first and second arms in the first and second bores; and a key cylinder assembly detachably connected to the locking assembly and adapted to actuate the locking assembly to an unlocked state to unlock the first and second arms in the first and second bores, the key cylinder assembly having a body having a key end and driver end; a bible with pins, and springs in channels; and a cylindrical central cavity extending from the key end to the driver end of the body, the bible channels in communication with the cylindrical central cavity, a key cylinder plug having a key end and a opposing driver end and a circular surface, the cylinder plug adapted to be received in and rotate in the cylindrical central cavity, the key cylindrical plug having a key slot extending from the key end to the driver end and dividing the key cylinder plug into first and second hemispheres, the key cylinder plug having channels with pins, the channels in the plug and in the body being coaxial when the channels are aligned, the key slot adapted to receive a bitted key to align the ends of pins in the channels in the plug with the circular surface of the plug to permit rotation of the plug in the cylindrical central cavity of the body, the driver end of the plug having a half-round driver extending axially outward from the driver end of the first hemisphere and a pin hole extending axially inward in the driver end of the second hemisphere. The key cylinder plug can have a pin removably secured or detachably received in the pin hole.

DETAILED DESCRIPTION OF THE INVENTION

Figure 1:
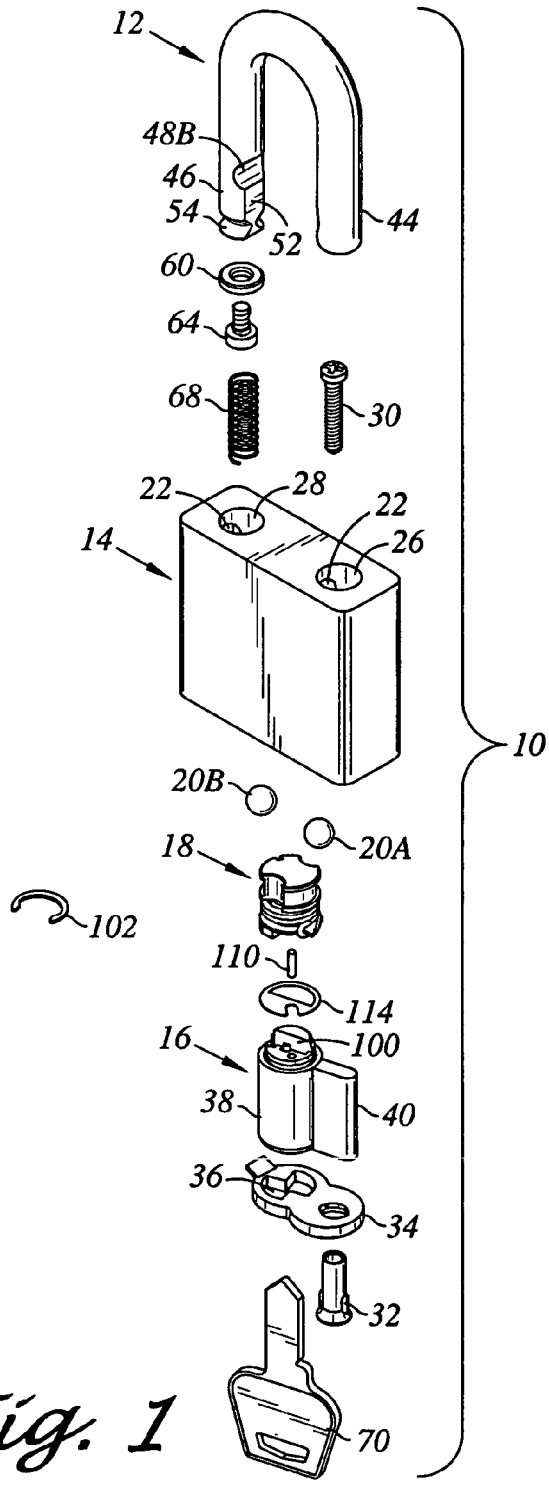
FIG. 1 is a top perspective view of the disassembled lock of the present invention.
Figure 3:
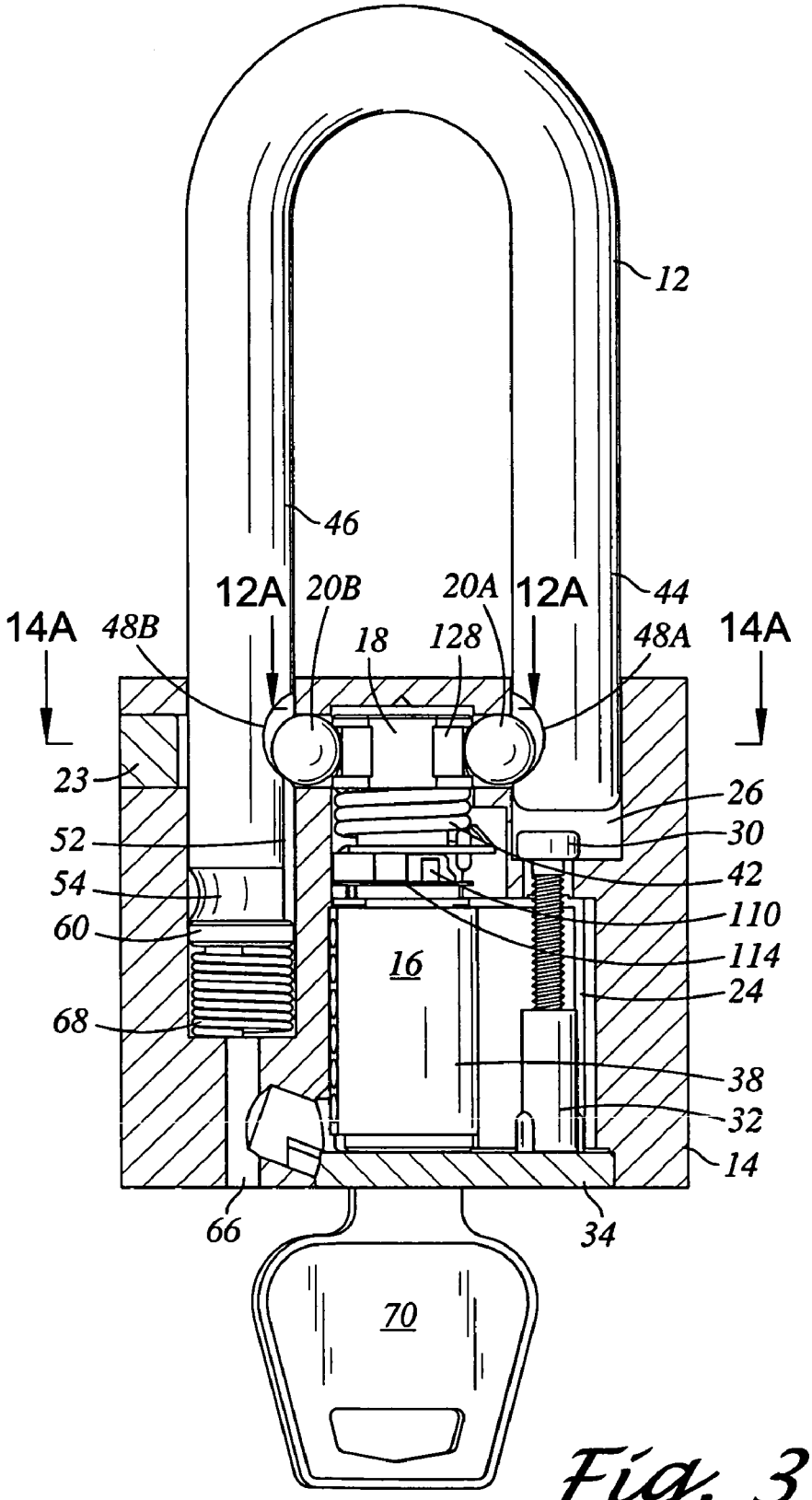
FIG. 3 is a front cross sectional view of the lock of the present invention in the locked state.

Referring to FIG. 1, the lock 10 of the present invention comprises a shackle 12, a lock body 14, a key cylinder assembly 16. The shackle 12 has a first arm 44 and a second arm 46. Each arm has a notch 48A and 48B which oppose each other. The second arm has a flat portion 52 below the notch 48B and a groove 54 circling the base of the second arm and terminating on the flat. In one embodiment of the invention, a retainer 60 is secured to the shackle with a threaded screw 64. The first arm 44 is adapted to be slidably moved in and out of the first shackle bore 26 for locking and unlocking the lock. The second arm 46 is adapted to be slidably and rotably moved in the second shackle bore 28. A biasing spring 68 is located at the bottom of bore 28 to make the shackle spring up when the lock is unlocked. Some locks are made without the spring 68. In the lock which is shown in other FIGS. 3–5, there is a lock assembly cavity 24 which is open to the bottom of the lock body 14. Crossing from side-to-side is a lock ball bore 22 extending from the side of the lock body through the second shackle bore 28 through the top of the lock assembly cavity in and to the first shackle bore 26. The bore is drilled in from one side of the lock body through the second shackle bore 28 and partially into the first bore 26 and plugged with a plug 23 (see FIG. 5). Lock balls 20A and 20B are positioned in the lock ball bore. A lock ball retainer 18 (FIGS. 3–5, 8 and 13) is positioned at the top of the lock assembly cavity and the lock balls are adapted to be received in notches 126A and 126B of the retainer when the lock is in the unlocked state and to rollingly engage lock ball race 128 of the retainer when the lock is in the locked state (see FIGS. 3, 14A). A key cylinder assembly 16 is located in the bottom portion of the lock assembly cavity 24. The key cylinder assembly is made up of the key cylinder body 38 and cylinder plug 100.

Figure 9A:
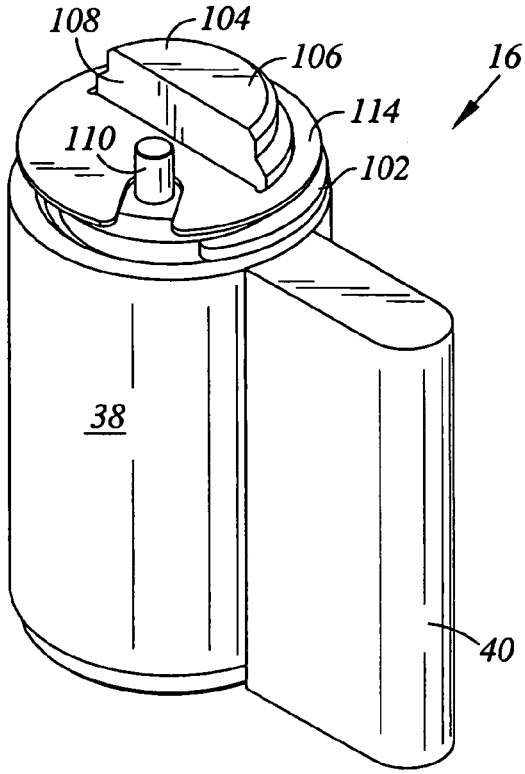
FIG. 9A is a driver end perspective view of the key cylinder assembly of the present invention with the anti-pick shield.
Figure 9:
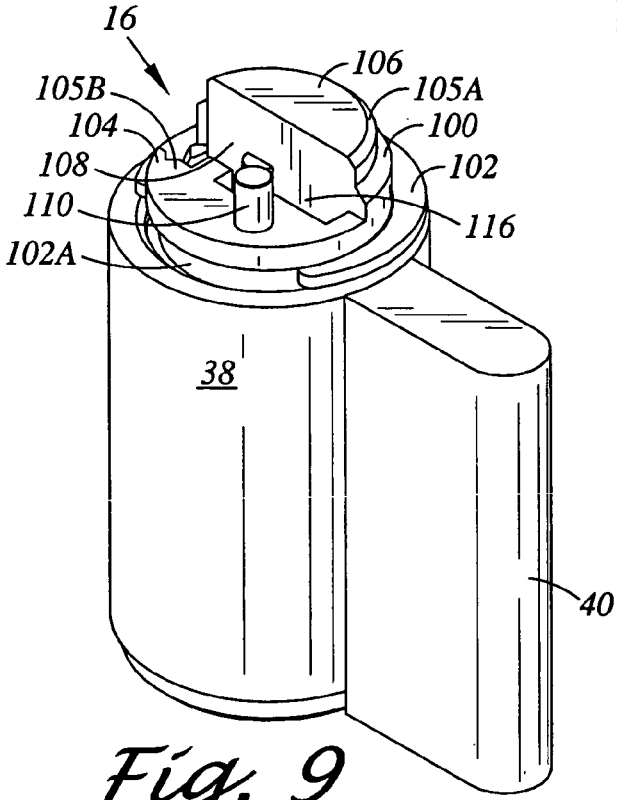
FIG. 9 is a driver end perspective view of the key cylinder assembly of the present invention.
Figure 10:
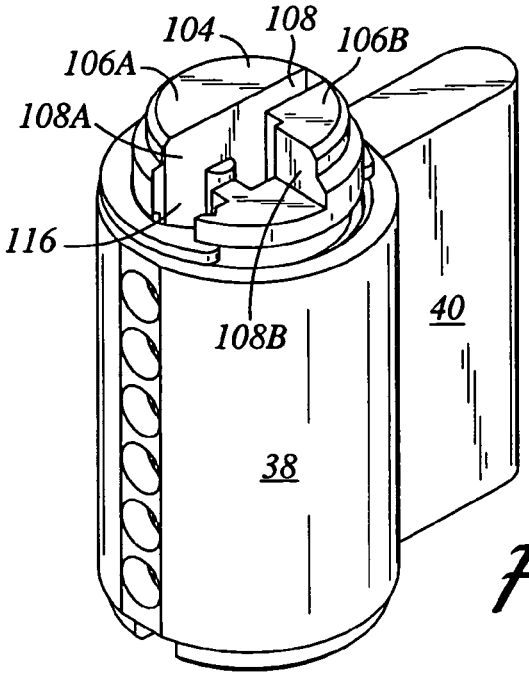
(PRIOR ART) Fig. 10
FIG. 10 is driver end perspective view of the a key cylinder assembly of the prior art.
Figure 11:
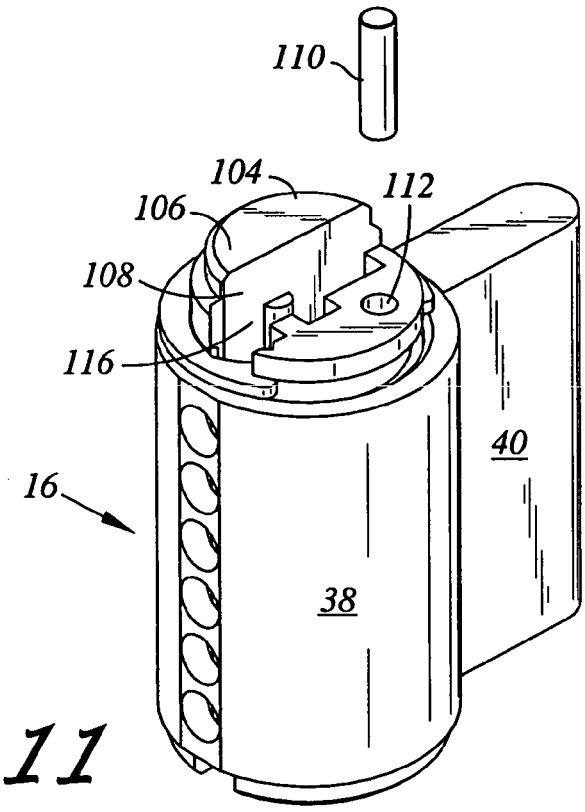
FIG. 11 is a driver end perspective view of the key cylinder assembly of the present invention.

Referring to FIGS. 9–11, except as otherwise indicated herein, the key cylinder assembly 16 is of conventional design and has bible or pin spring housing 40 with series of pin channels or chambers in communication with the cylindrical central cavity of the key cylinder assembly and containing pins and pin springs (not shown). The key cylinder plug 100 has channels or holes with pins (not shown). The pins of the plug are adapted to engage the teeth of a key in the conventional manner. The key cylinder plug 100 has a key slot 116 adapted to receiving a key in the key end which is positioned at the bottom of the lock when the lock is assembled. The plug 100 has an outer circumference or circular surface. The plug pin channels are coaxial with the pin channels of the bible 40 when the channels of the plug and bible are aligned as they are when the lock is locked and the key is removed. The plug 100 is received in the cylindrical central cavity of the assembly 16 and is adapted to be rotated therein. The lock is keyed so that upon insertion of the appropriately bitted key, the pins in the plug and the top pins of the body 40 are aligned with the outer circumference of cylinder plug 100 in order to unlock the key cylinder assembly and permit rotation of the key cylinder plug in the cylindrical central cavity of the key cylinder body 38. The key slot 116 divides the plug into two longitudinally extending hemispheres. In the embodiment shown, the driver end of the cylinder plug has a half-round (roughly half-round in cross section) driver 106 extending axially outward from the driver end 104 of the first hemisphere 105A of the plug. The driver has a straight driver face 108 (see FIGS. 9 and 11). The driver end 104 of the plug on the second hemisphere 105B has a pin hole 112 which extends axially inward and is adapted to detachably receive pin 110. For security, the driver end 104 of the cylinder plug is fitted with an anti-pick shield 114 to block the remote end of the key slot 116 (see FIG. 9A). The shield 114 has a half-round hole to receive the half-round driver 106 and a notch to permit insertion of the pin 110 into the pin hole 112 of the cylinder plug 100.

The lock ball 20A is retained in one end of the lock ball bore 22 by a constriction (not shown) in the bore at the junction of the lock ball bore 22 and the first shackle bore 26 and at the other end of the bore by the lock ball retainer 18. The lock ball 20B is retained in the lock ball bore 22 at one end by the lock ball retainer and at the other end by the second arm 46 of the shackle. The key cylinder assembly 16 and the lock ball retainer 18 are maintained within the lock assembly cavity 24 by a cover plate 34 which fits into a recess at the bottom of the lock body (see FIGS. 1 and 3–5). The cover plate is retained by cover plate nut 32 which extends into the lock assembly cavity 24 and by cover plate screw 30 (a machine screw that can have a Phillips head, recessed hexhead, recessed square head, or the like) which extends through the bottom of the first shackle bore 26 into the lock assembly cavity (see FIGS. 3–5). The cover plate has a cutout hole 36 (see FIG. 1) designed to permit insertion of the key 70 into the key slot (not shown) of the cylinder plug 100 and permits the key and cylinder plug to be turned to open the lock.

As mentioned above, higher quality locks have a second arm retaining means that permits the shackle to be removed. In most prior art locks, replacement of the shackle normally requires that, at a minimum, the key cylinder assembly and the lock ball retainer must be removed to remove the second arm of the shackle. Some locks have a pin extending through the side of the lock body that retains the shackle in the lock body in the unlocked state.

Figure 2:
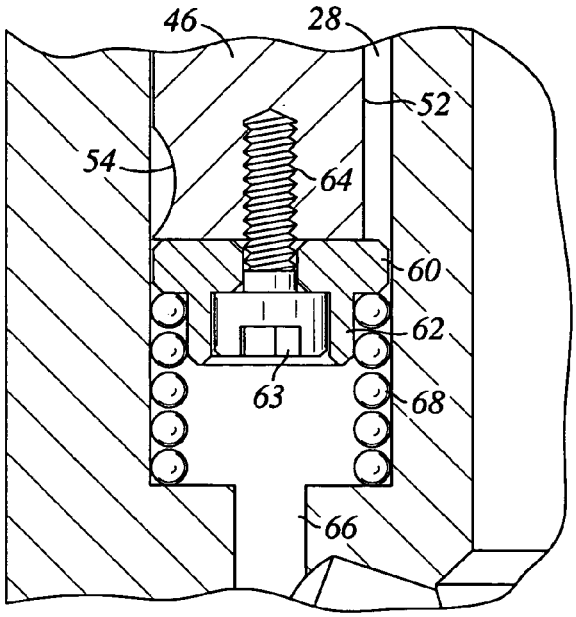
FIG. 2 is partial enlarged cross sectional view of the shackle retaining assembly for the second arm of the lock shackle.

Referring to FIGS. 2–7, in one embodiment of the present invention, the second arm 46 of the shackle 12 has threaded bore 56 extending from the end of the second arm 46 a short distance below the notch 48B. A torus-shaped retainer 60 with an untapped bore is secured to the base of the second arm by shackle retainer screw 64. Optionally, this retainer 60 can have a spring guide 62 as shown in FIG. 2 or the head of the shackle retainer screw 64 can serve as a spring guide (see FIG. 4). A spring guide would not be needed for those locks that do not have a shackle return spring 68. In the embodiment of the invention, the lock body 14 has an access bore 66 extending up from the bottom of the lock body to the bottom of the second shackle bore 28. The head of the shackle retaining screw 64 preferably has a recessed drive head, such as an Allen hexhead, a square drive or the like. The appropriate driver can easily be inserted through access bore 66 to engage the recessed drive surface. In the preferred embodiment, a recessed driver head, such as an Allen hexhead drive head, that can align, or near align, the machine screw with the driver is preferred because it eases alignment of the machine screw 64 with the threaded bore 56 at the end of the second arm 46 of the shackle 12.

Figure 4:
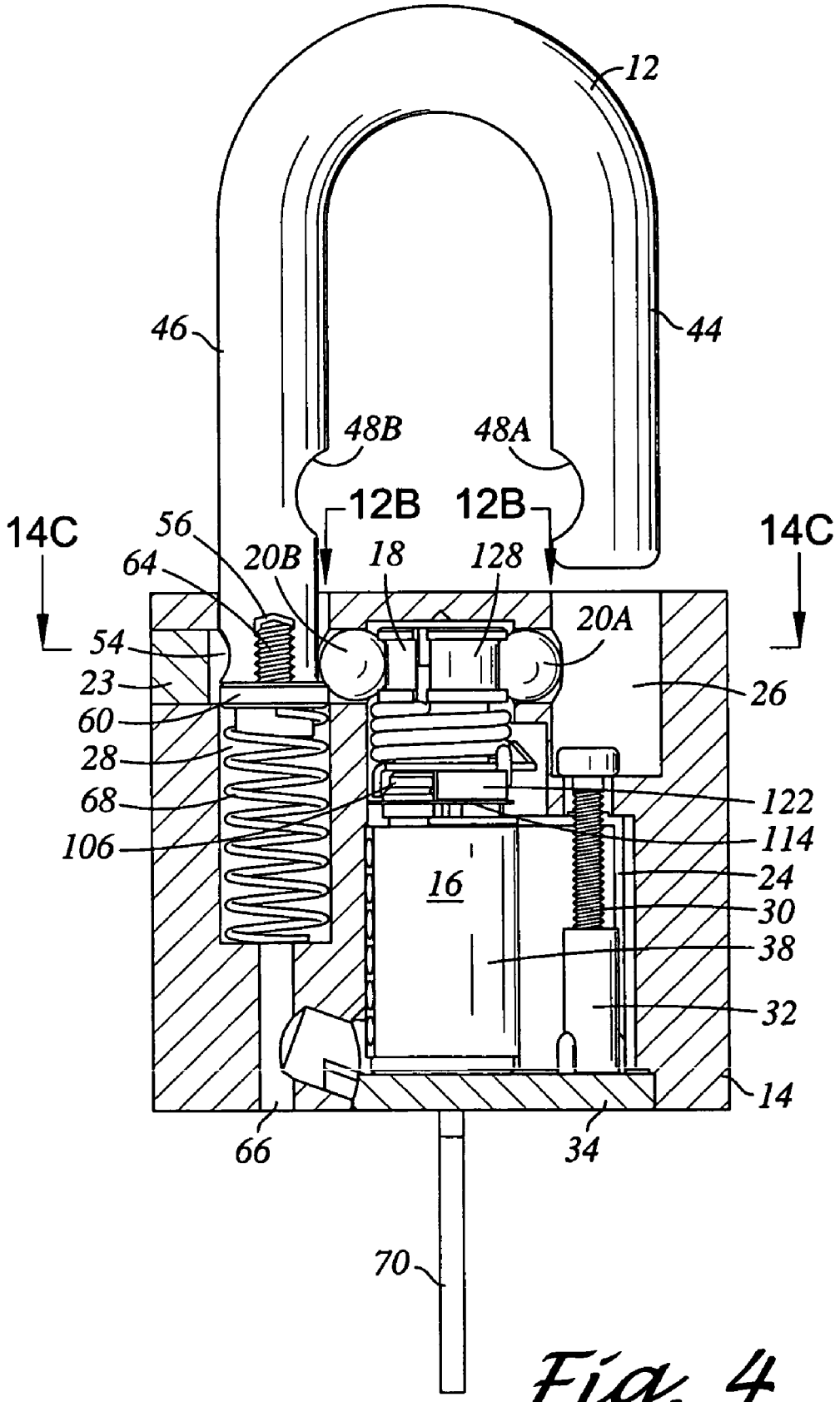
FIG. 4 is a front cross sectional view of the lock of the present invention in the unlocked state.
Figure 5:
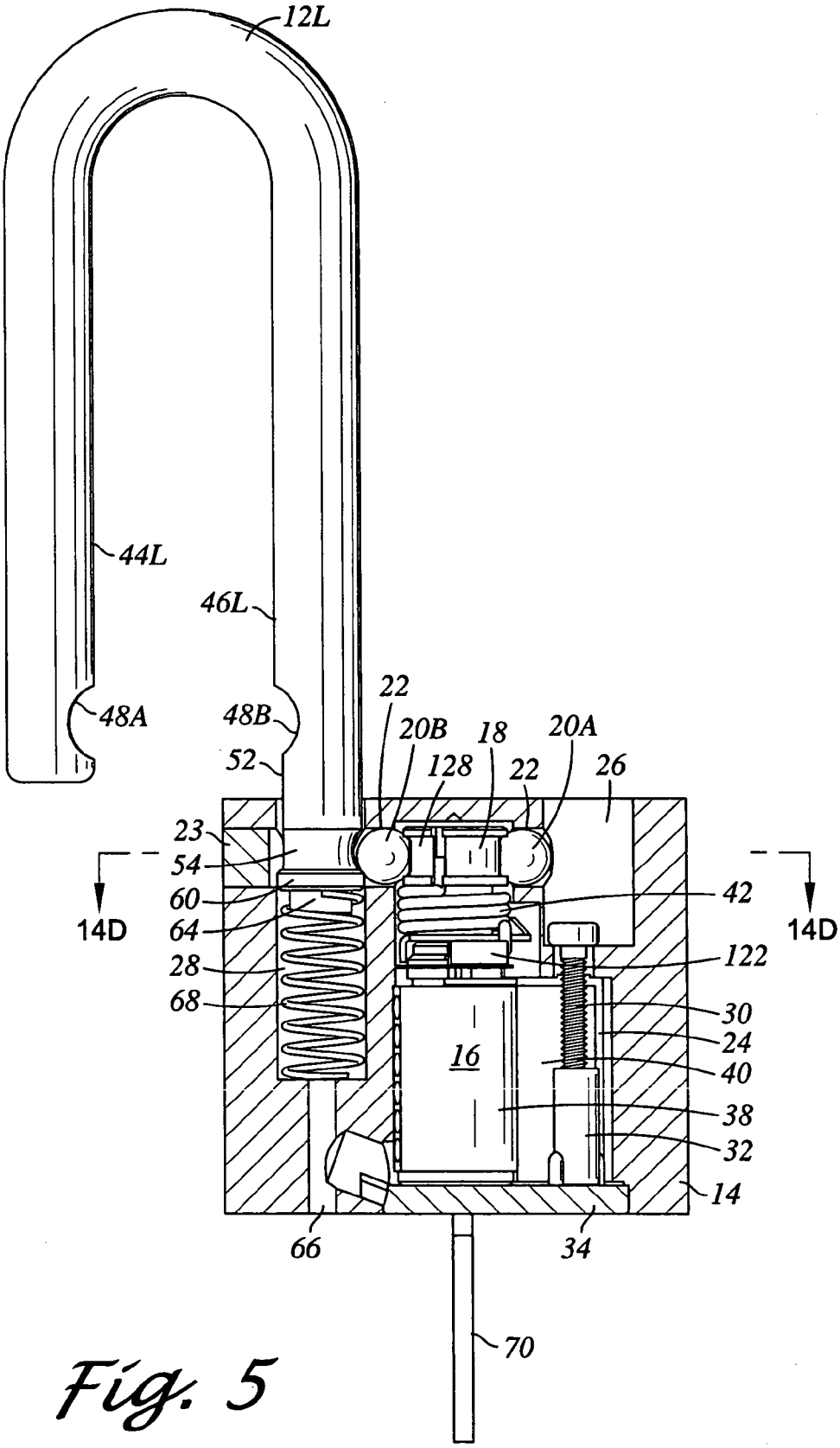
FIG. 5 is a front cross sectional view of the lock of the present invention in the unlocked state with the shackle swiveled to the side.
Figure 6A:
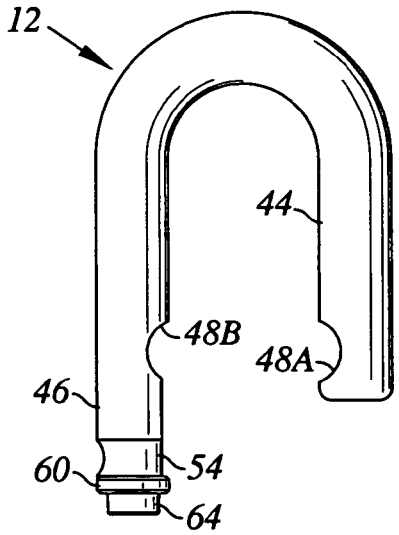
FIG. 6A is a plan view of a short shackle of the present invention.
Figure 6B:
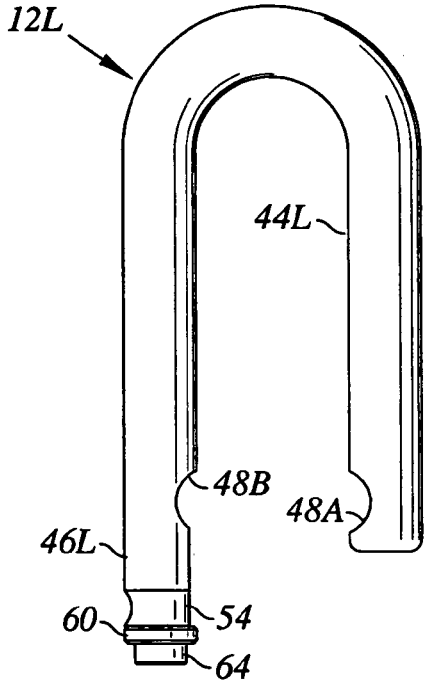
FIG. 6B is a plan view of a long shackle of the present invention.
Figure 7:
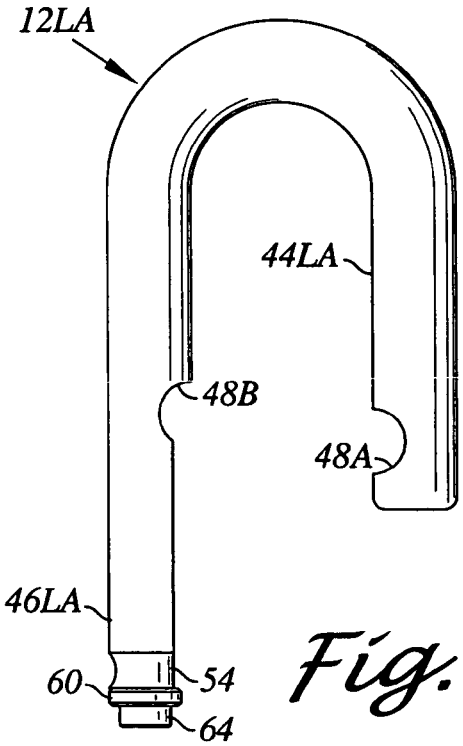
FIG. 7 is a plan view of another embodiment of a long shackle of the present invention.
Figure 8:
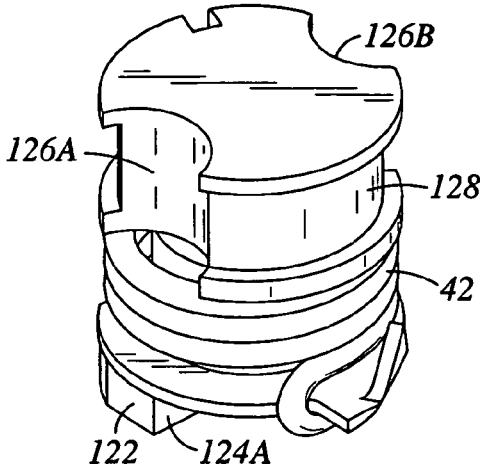
FIG. 8 is a top perspective view of the lock ball retainer of the present invention.

In this embodiment of the invention, when it is desirable to change the shackle, either to replace a shackle or to substitute a longer or shorter shackle, the appropriate driver is conveniently inserted through access bore 66 of the lock body 14 (see FIGS. 3–5) into the recessed driver receiver hole 63 in the head of the shackle retainer screw 64 (FIG. 2) to loosen the screw before the lock is unlocked. The lock is then unlocked and the retaining screw is freed from the base of the second arm of the shackle using the retaining screw driver (not shown). Turning the key cylinder assembly 16 to the unlocked position with a key, the shackle is now free of the retainer 60 and the shackle can be completely removed from the lock body after being rotated 180 degrees as shown in FIG. 5. A long shackle, such as 12L of FIG. 6B having long first and second arms 44L and 46L, can be replaced by a shorter shackle 12 of FIG. 6A or vice versa. The second arm 46 of the new shackle is inserted into the shackle bore 28 after the shackle retainer 60, the shackle return spring 68 and the shackle retainer screw 64 have been positioned in the bore 28. The second arm of the shackle is lowered into the bore ensuring that the lock ball 20B is residing in lock ball bore 22. The shackle retainer screw 64 is worked through the bore of the retainer 60 and threaded or screwed into the threaded bore 56 of the shackle employing the appropriate driver, and tightened. To ensure that the shackle retaining screw 64 remains in the shackle 12, the retaining screw 64 can have lock threads, or an adhesive can be applied to the threads of the screw before reassembly, or the screw can have a known built-in thread locking means to secure the screw into the shackle.

Referring to FIGS. 8–14E, except as described below, the key cylinder plug 100 is similar to conventional key cylinder plugs having a cylinder body 38 with a bible or pin spring housing 40 containing pins and pin springs in a series of parallel channels. The plug 100 is retained in the cylinder body 38 by a retainer 102 which engages groove 102A at the driver end 104 of the plug 100. The cylinder plug 100 adapted to be rotated within the key cylinder body 38 when a key is inserted into the key slot 116. The key slot extends from the key end to the driver end 104 of the plug and divides the plug into two hemispheres 105A and 105B. The key is bitted for the pin configuration of the key cylinder assembly. When the proper key is inserted into the key slot 116 of the plug, the bottom pins located in the key cylinder plug 100 are aligned on the outer circumference or circular surface of the key cylinder plug 100 and the inner circumference of the central cylindrical cavity of the key cylinder body 38 bore permitting the key cylinder plug 100 to be rotated in the central cylindrical cavity of the key cylinder body to unlock the lock.

A driver 106 extends axially outward from the hemisphere 105A of the driver end 104 of the key cylinder plug. In cross section, the driver 106 has a half-round signature. The driver 106 has a flat driver surface 108. The driver end 104 of the cylinder plug 100 also has a hole 112 extending axially inward from the hemisphere 105B to receive a pin 110 (FIGS. 9, 9A and 11).

When the lock is assembled, the driven end 120 of the lock ball retainer 18 (FIG. 13) engages the driver end 104 of the key cylinder plug (FIGS. 9, 9A, and 11). A step 122 extends from the driven end 120 of the lock ball retainer and has driven surfaces or faces 124A and 124B. Driven surface 124A interacts with pin 110 when a pin is seated in hole 112. Driven surface 124B interacts with the driver surface 108 of the driver 106. When the appropriate bitted or cut key 70 is inserted into the key slot 116 of the key cylinder plug 100 of the key cylinder assembly when the cylinder is in the key insertion position, such as when the lock is locked (FIG. 3) and the key cylinder plug is turned from about 60 degrees to about 90 degrees, driver surface 108 of the driver 106 engages the driven surface 124B and rotates the lock ball retainer 18 so that the notches 126A and 126B are aligned with the lock ball bore 22 to permit the lock balls 20A and 20B, respectively, to roll or slide into the notches 126A and 126B and out of notches 48A and 48B, respectively, of the shackle. The coil return spring 42 secured to the lock ball retainer is tightened when the retainer is rotated to unlock the lock. The spring 42 biases the lock ball retainer return to its original position, i.e. the lock positioned. As mentioned above, the lock ball retainer is rotated anywhere from about 60 to about 90 degrees. Accordingly, when the pin 110 is not seated in hole 112, the key cylinder plug 100 can be rotated back to its original key insertion position without the driven surfaces 124A and 124B contacting the driver surfaces 108. When the key cylinder plug 100 is rotated to the key insertion position, the key can be removed from the key slot 116 of the plug. When the plug 100 is not rotated back, or is rotated to a different position, the key cannot be removed from the key slot 116 unless the key cylinder plug is rotated back to the key insertion position. The key cannot be removed because the bottom pins of the body 38 are encapsulated in the channels of the key cylinder plug between the key cylinder body and the key. When the cylinder plug is rotated out of the key insertion position, the pins are between the bitted key and the inner circumference of the key cylinder body therefor the key cannot be pulled out of the key slot. When the key cylinder plug is rotated to the key insertion position, the pins in the channels of the plug and body can move into the channels in the pin spring housing or bible 40 and the key can be slid out of the key slot.

For many applications, it is desirable that the key be retained in the lock when the lock is in the unlocked position. This type of key retention is utilized for security, convenience and/or safety purposes. The use of key retention also forces the user to lock the lock before he or she can remove the key. Thus, the operator knows that if he or she has the key, the lock must be in the locked state.

There are other applications where it is not desirable to have the key retained in the lock in either the locked or unlocked position. For example, when there are a number of keyed-alike locks that are to be opened at around the same time by the same person, that person needs to be able to unlock the lock and remove the key with the lock in the unlocked state and go to the next lock and unlock it and the like.

This improvement in the cylinder plug for padlocks permits the manufacture of one type of key cylinder plug. In the padlocks presently available, two types of key cylinder plugs must be manufactured, one is similar to that shown in FIG. 11 in key cylinder assembly 16 except lacking a pin 110 and hole 112. The other prior art key cylinder plug is illustrated in FIG. 10 and shows a two-part driver 106A and 106B being roughly ¾-round and cut with the key slot 116. The key cylinder plug illustrated in FIG. 10 is used for those padlocks that retain the key after the lock is unlocked, i.e. key retaining. The other prior art key cylinder pin which is similar to that illustrated in FIG. 11 but lacks a pin 110 and hole 112 is used for locks that do not retain the key when the lock is unlocked, i.e. non-key retaining. Thus, when employing prior art padlocks, the locksmith has to disassemble the lock and remove the key cylinder assembly and replace it with another key cylinder assembly or, alternatively, replace the key cylinder plug and then reinstall the key cylinder back into the lock to convert a lock from key retaining or non-key retaining or vice versa. The padlock of the present invention makes it much easier for the locksmith. The key cylinder assembly or the key cylinder plug does not have to be replaced. To convert a non-key retaining lock to a key retaining lock, the key cylinder assembly is removed from the lock and the pin 110 is inserted in hole 112. To convert the lock from key retaining to non-key retaining, pin 110 is removed from the hole 112 to convert the lock. Thus, with the improved lock of the present invention, the locksmith does not have to maintain a large inventory of different types of cylinder assemblies or key cylinder plugs to convert locks from key retaining to non-key retaining, etc.

Figure 12A:
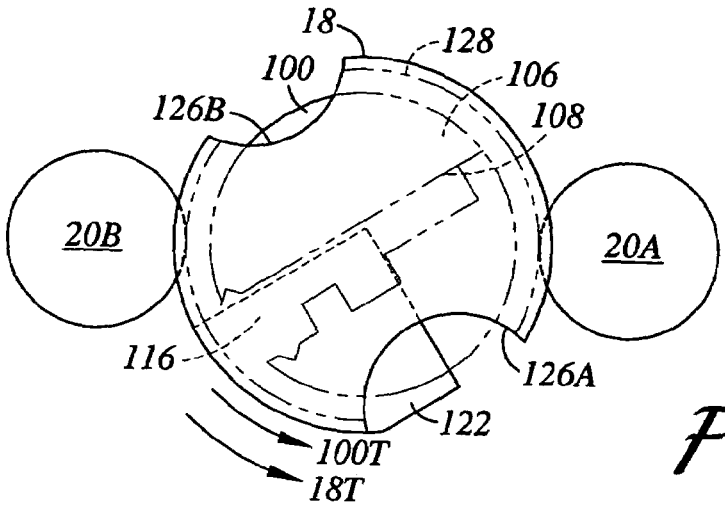
FIG. 12A is a cross sectional view taken along lines 12A—12A of FIG. 3.
Figure 12B:
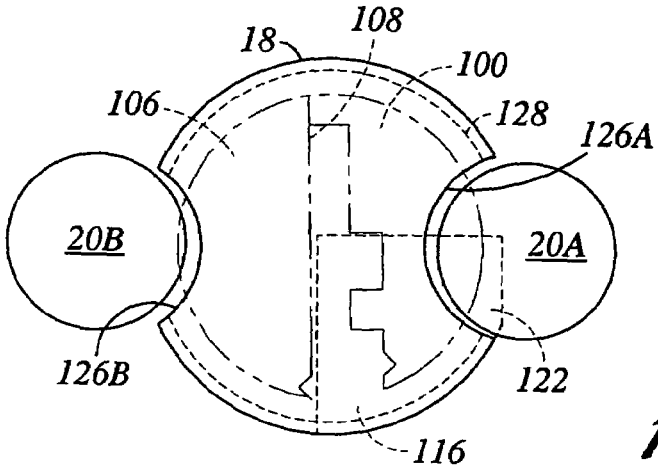
FIG. 12B is a cross sectional view taken along lines 12B—12B of FIG. 4.
Figure 12C:
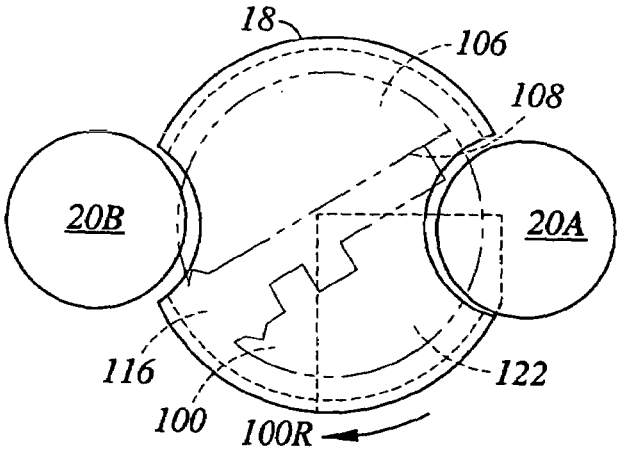
FIG. 12C is a cross sectional view similar to FIGS. 12A and 12B.

Referring to FIGS. 12A–12C, these figures show the unlocking sequence of a non-key retaining or nonretaining key padlock, i.e. the key can be removed from the lock in the unlocked state. The driver end 104 of the cylinder plug is not fitted with pin 110 in pin hole 112 (not shown). In order to remove a key from a padlock, the key cylinder plug 100 must be returned to the lock position, also called the key insertion position, as described above. When an unlocked lock is locked, that is when the shackle arms are secured back into the shackle bores of the lock body with the lock balls 20A and 20B rolling into the notches 48A and 48B of the shackle, the lock ball retainer 18 is free to rotate and is biased to rotate back to the locked position by spring 42.

In FIG. 12A, the lock balls 20A and 20B are riding on the retainer lock ball race 128 as described above. The key cylinder plug 100 is in the key insertion position. When the appropriate key is inserted into the key slot 116 of the key cylinder plug 100, the key cylinder plug can be rotated (counterclockwise 100T) as described above. The driver 106 of the key cylinder plug engages the step 122 of the retainer 18 and rotates the lock ball retainer 18 to the open or unlocked position (counterclockwise 18T) wherein the lock balls 20A and 20B can roll or side into the notches 126A and 126B, respectively. The notches 48A and 48B of the shackle arms 44 and 46 are then unrestrained by the balls and the shackle (not shown) can then be elevated out of the lock body as described above. When the shackle is extended outwardly to its full length (see FIGS. 4 and 5); it is restrained by ball 20B and retainer 60, but, it can be rotated with ball 20B riding in groove 54 on the second arm as described above. The second arm can rotate in and partially slide in and out of bore 28 but cannot be removed. Flat 52 of the second arm 46 can be slid by the lock ball 20B from the notch 48B to the groove 54 permitting the second arm to slide in and out of bore 28 (retainer 60 is restrained by lock ball 20B and prevents the second arm from being fully slid out of bore 28).

In the unlocked position, the lock ball retainer 18 cannot rotate back to the locked position because notch 126B is engaged by lock ball 20B. Lock ball 20B can be fully withdrawn from notch 126B when notch 48B of the second arm is properly in position to receive lock ball 20B when the lock is being locked and put into the locked state. When the lock is opened, the key cylinder plug is rotated by the operator from the key insertion position to the unlocked position. Once the lock is open (FIG. 4), the key cylinder plug can be manually rotated back by the operator to the key insertion position (clockwise 100R of FIG. 12C), by use of the key. As shown in FIG. 12C, the step 122 does not interfere with the rotation of the driver 106 and plug 100 because there is no pin 100 present. In this position, and only in this position, the key 70 can be removed from the lock. If the key cylinder plug cannot be rotated back to the key insertion position, the key cannot be removed from the lock. When both arms of the shackle are in bores 26 and 28 as described above to lock the lock with the lock balls 20A and 20B engaged in the notches 48A and 48B, respectively, of the shackle, the lock ball retainer which is under tension from the spring 42 rotates back to its original lock position shown in FIG. 12A. The lock balls ride on the ball race 128 of the retainer 18. If the key cylinder plug was not earlier rotated manually back to the key insertion position, step 122 will drive driver 106 and rotate the key cylinder plug back to the key insertion position shown in FIG. 12A.

The majority of locks are key nonretaining type locks and allow the user to open the lock, leave it unlocked, and remove the key. However, there are instances, normally dealing with security or safety situations, where it is desirable that the key not be removable when the lock is in the open position, i.e. unlocked. The key retaining lock of the prior art has the driver 106A with roughly a ¾-round cross section as shown in FIG. 10. The open quadrant between the two faces 108A and 108B of the driver 106A is occupied by the quarter-round section of the step 122 of the lock ball retainer. Thus, in the prior art locks, the lock manufacturer must supply two key cylinder assemblies or alternatively two key cylinder plugs, one plug having a half-round driver for a non-key retaining lock and a ¾-round driver as shown in FIG. 10 for a key retaining lock. This requires both the lock manufacturer and the locksmith to keep a large inventory of either key nonretaining locks and key retaining locks or key cylinder assemblies for key nonretaining locks and key retaining locks or the appropriate key cylinder plug. Replacement of key cylinder plugs is a time consuming effort, and although skilled locksmiths can do it in a reasonable amount of time, it still requires a number of operations and skill since the appropriate size pins must be inserted into the key cylinder plug.

Figure 12D:
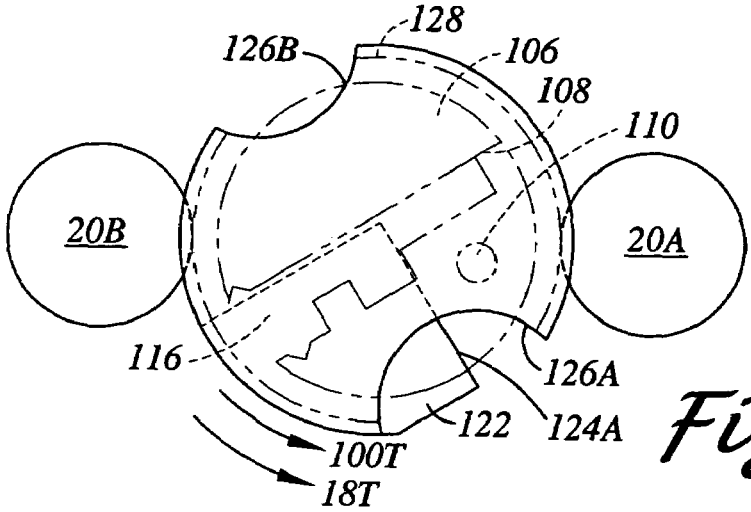
FIG. 12D is a cross sectional view similar to FIG. 12A with a pin.
Figure 12E:
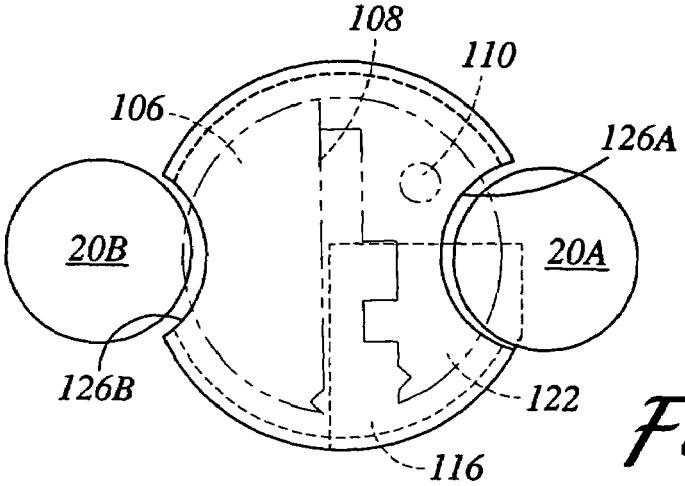
FIG. 12E is a cross sectional view similar to FIG. 12B with a pin.
Figure 12F:
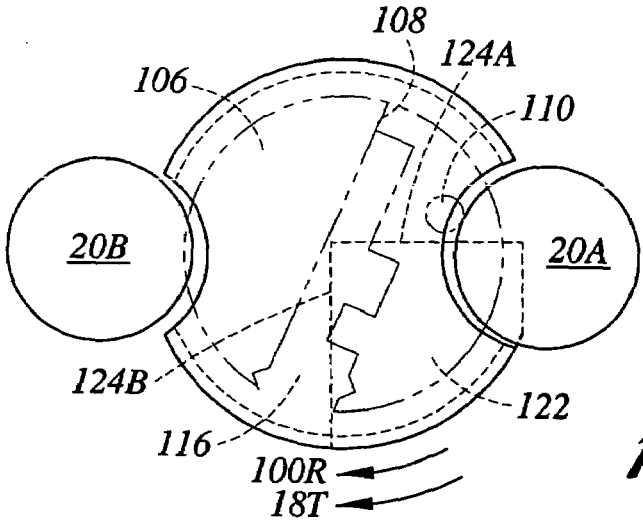
FIG. 12F is a cross sectional view similar to FIG. 12C with a pin.
Figure 13:
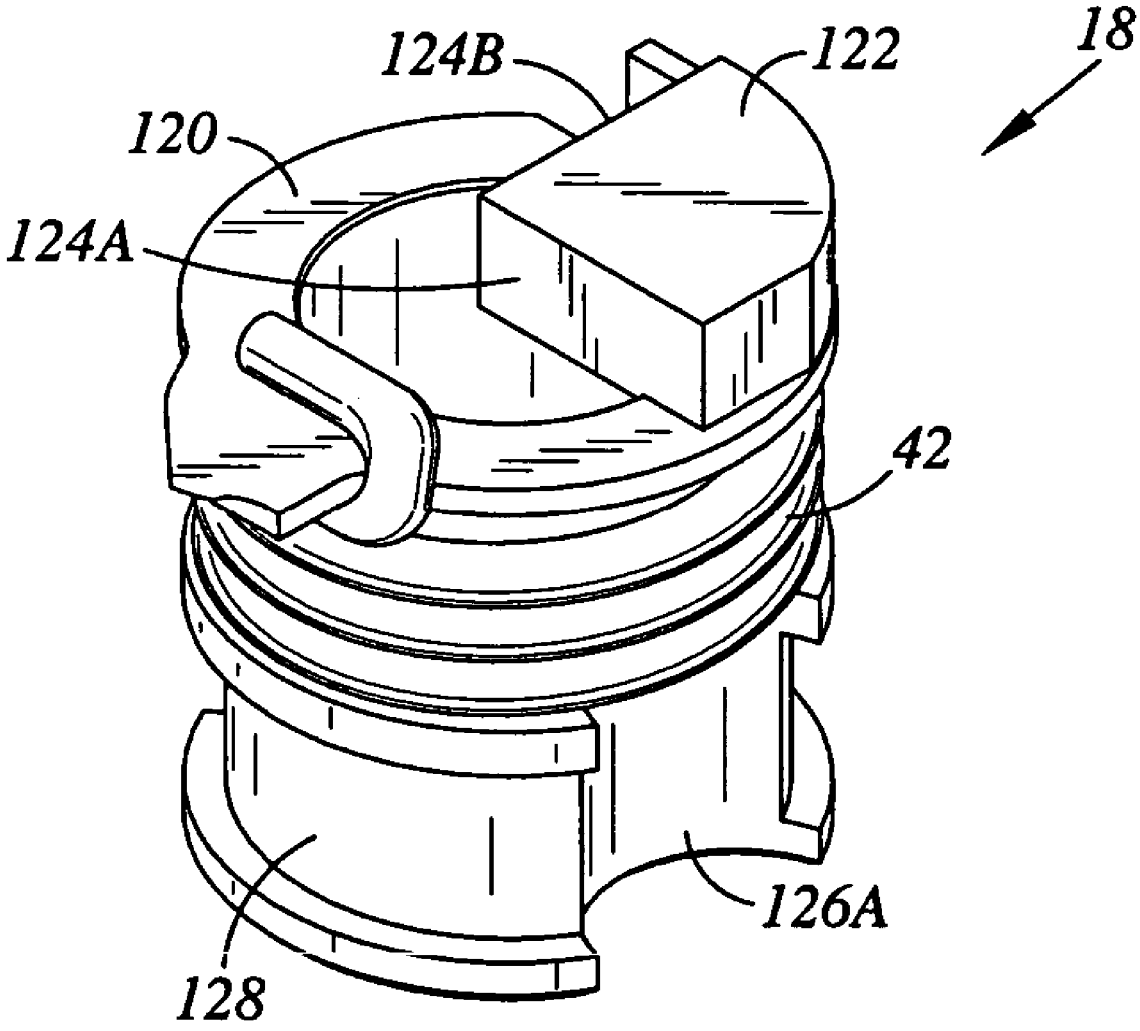
FIG. 13 is a driven end perspective view of the lock ball retainer of the present invention.

Referring to FIGS. 12D–12F, these figures show the unlocking sequence of a key retaining lock wherein the key cannot be removed from the lock until the lock is in the locked state. The driver end 104 of the cylinder plug 100 has a pin 110 inserted into the pin hole 112 (see FIGS. 9, 9A and 11).

FIG. 12D shows the retainer 18 positioned so that the lock balls 20A and 20B are resting on the lock ball race 128. The key cylinder plug of the lock is identical to the key cylinder plug for the lock shown in FIGS. 12A–12C with the exception that the pin 110 has been inserted into the hole 112 at the driver end 104 of the key cylinder plug as described above. When the key cylinder plug 100 is rotated (counterclockwise 100T) to open the lock, driver 106 of the key cylinder plug engages the step 122 of the lock ball retainer 18 and rotates the retainer to align the notches 126A and 126B so that lock balls 20A and 20B, respectively, can roll or slide into the notches 126A and 126B freeing the notches 48A and 48B of the shackle permitting the shackle to slide out from the lock body, thus unlocking the lock as shown in FIG. 4. As described above with respect to FIGS. 12A–12C, the second arm 46 of the shackle remains in bore 28 and can be slid up and down the bore 28 with the flat portion 52 sliding by lock ball 20B and optionally can be rotated with lock ball 20B rotating on groove 54 at the base of the shackle (FIG. 5). The second arm of the shackle prevents lock ball 20B from fully withdrawing from notch 126B which in turn prevents the lock ball retainer 18 from rotating back to its original position as urged by spring 42 as described above when the lock is unlocked. Except for pin 110, the key cylinder plug 100 could be rotated back to the key insertion position to remove the key. However, since lock ball retainer 18 is fixed in position in an unlocked position when the lock is in the unlocked state regardless of the position of the shackle in the open position, step 122 is fixed in place. Pin 110 is in the empty quadrant between step 122 and driver 106. When the plug 100 is rotated (clockwise 100R) the pin engages step 122 which prevents full rotation of the key cylinder plug 100 (FIG. 12F) back to the key insertion position (FIG. 12D), because pin 110 comes in contact with driven surface 124A of step 122 and prevents the key cylinder plug from being fully rotated back to the key insertion position. When the shackle is fully returned to the lock body and locked, positioning notches 48A and 48B of the shackle so that the lock balls 20A and 20B, respectively, can slide in or roll in to the notches, the lock balls can be urged out of the notches 126A and 126B of the lock ball retainer by the rotating force exerted by spring 42 on the retainer 18. The retainer is then able to rotate back to the locked position shown in the FIG. 12D which rotates the step 122 (clockwise 18R), which in turn permits the step 122 to engage the driver 106 and rotate the key cylinder plug and pin 110 back to the key insertion position permitting removal of the key.

The present invention provides that the locksmith and the lock manufacturer only have to produce one key cylinder plug for locks that are convertible key retaining or key nonretaining. By inserting a pin 110 into hole 112, the locks can be converted to key retaining locks. Vice versa, the pin can be removed from hole 112, thus converting the locks from key retaining locks to non-key retaining locks. This cuts down on the amount of inventory that the locksmith has to maintain in his facility in order to be able to furnish both key retaining locks and key nonretaining locks.

Figure 14A:
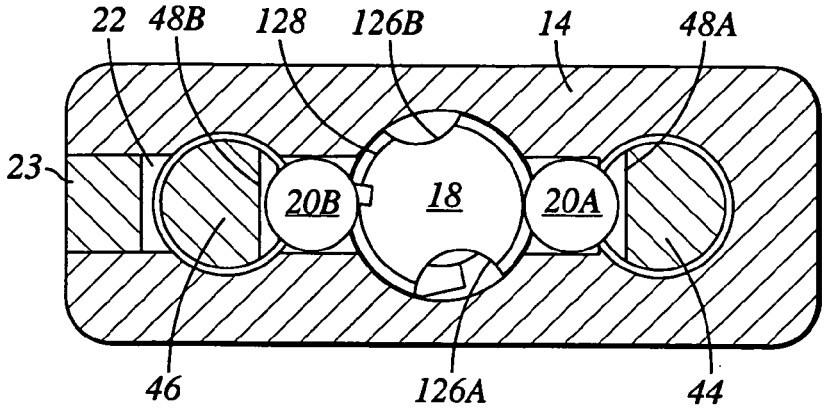
FIG. 14A is a cross sectional view taken along line 14A—14A of FIG. 3.

Referring to FIGS. 14A–14F, this is a top cross sectional view of the lock showing the position of the shackle arms 44 and 46, the lock balls 20A and 20B and the lock ball retainer 18 in different lock states of the lock. FIG. 14A illustrates the lock in the locked position with the lock balls 20A and 20B engaging the notches 48A and 48B of the shackle arms 44 and 46 to lock the shackle into the body. The balls are riding on the lock ball race 128 of the lock ball retainer 18 (FIG. 14A).

Figure 14B:
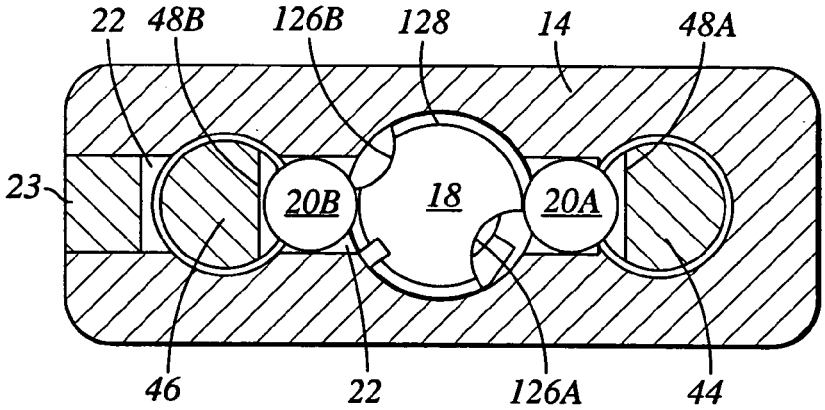
FIG. 14B is a cross sectional view similar to FIG. 14A wherein the lock ball retainer is being rotated counterclockwise to open the lock.

FIG. 14B illustrates the opening step of the lock wherein the lock ball retainer 18 is rotated approximately 45 degrees by the insertion of a key in the key slot of the key cylinder assembly (not shown) and rotation of the key which in turn rotates the key cylinder plug and the lock ball retainer 18 as described above. The lock is not fully open at this stage.

Figure 14C:
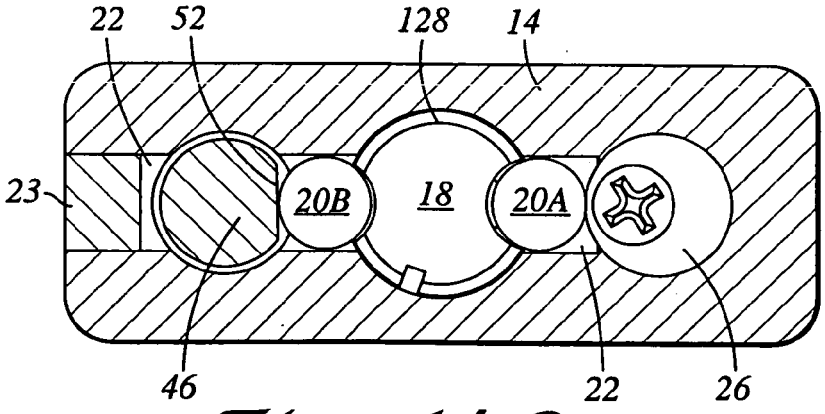
FIG. 14C is a cross sectional view taken along lines 14C—14C of FIG. 4.

FIG. 14C shows the lock in the open position with the shackle arm 44 removed from the shackle bore 26 and lifted up as shown in FIG. 4. Lock ball 20A and lock ball 20B are recessed into notches 126A and 126B, respectively. Although notch 126B is not deep enough to free bore 28 of ball 20B, shackle arm 46 can be slid up and down within bore 28 with the flat 52 sliding past ball 20B. The shackle cannot be rotated within bore 28 until the shackle is lifted to its full extent wherein ball 20B comes in contact with semicircular groove 54 which extends from one side of the flat 52 to the other side of the flat circumferentially at the end of the shackle as shown in FIG. 5.

Figure 14D:
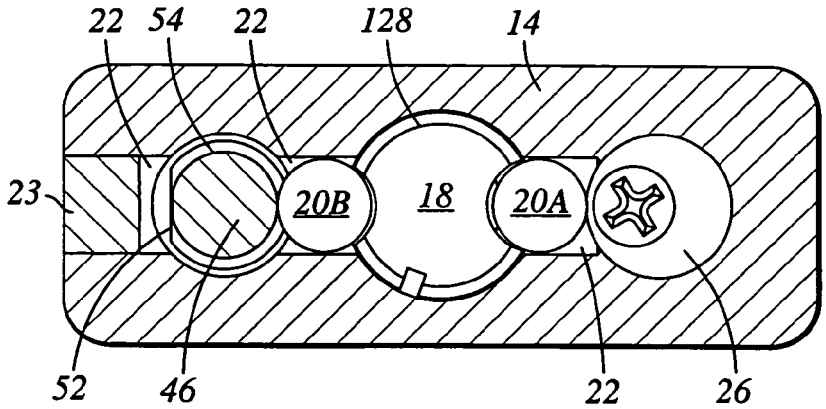
FIG. 14D is a cross sectional view taken along lines 14D—14D of FIG. 5.

FIG. 14D shows the lock in the open position with the shackle arm 44 removed from shackle bore 26 and rotated to the side as shown in FIG. 5. Lock ball 20A is recessed into a notch 126A and lock ball 20B is recessed into notch 126B. Notch 126A is deeper than notch 126B and permits the lock ball 20A to be fully recessed out of shackle arm bore 26. Lock ball 20B is partially recessed out of shackle arm bore 28, but there is sufficient clearance to slide the shackle up with lock ball 20B riding on the flat 52 of the second arm 46 of the shackle. When the shackle is fully lifted up wherein lock ball 20B can ride in groove 54 at the base of the shackle, the shackle can be rotated to the side as illustrated in FIG. 5.

Figure 14E:
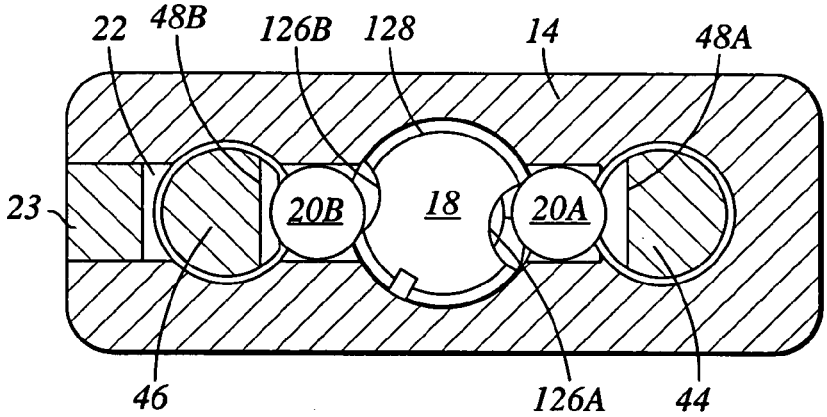
FIG. 14E is a cross sectional view similar to FIG. 14B wherein the lock ball retainer is rotating clockwise to lock the lock.

FIG. 14E illustrates the first step in locking the lock with both shackle arms fully inserted into the bores 26 and 28. The lock ball retainer 18 has been rotated about 20 degrees which starts to push or force the lock balls 20A and 20B out of the notches 126A and 126B, respectively, through the lock ball bore 22 into shackle arm bores 26 and 28 to engage notches 48A and 48B, respectively.

Figure 14F:
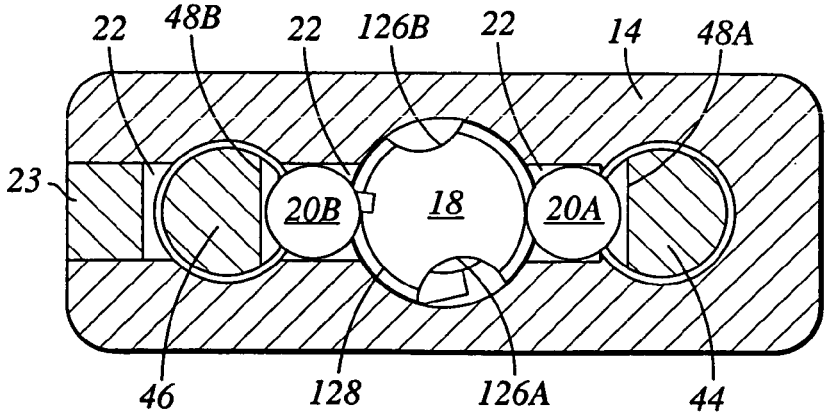
FIG. 14F is a cross section view identical to FIG. 14A.

FIG. 14F is identical to FIG. 14A and show the lock in the locked position with the lock balls 20A and 20B riding on the lock ball race 128 of the retainer 18 and fully engaging the notches 48A and 48B of the shackle arms.

Although the invention has been described with regard to specific embodiments, the intent is to cover equivalent embodiments which carry out the purpose and spirit of the disclosed invention. For example, the pin 110 can be substituted with a quarter-round pedestal that has a pin that fits in hole 112 or that has a hole that receives pin 110. The pin 110 can be square, round, triangular, etc., in cross section.

Although illustrated with the improved key cylinder assembly of the present invention, the shackle replacement embodiment can be used on virtually any padlock. For example, the shackle replacement embodiment of the present invention can be employed on various styles and constructions of padlocks, such as padlocks using small format IC core, padlocks using door cylinder assemblies, used in combination with an adapter in padlocks, and padlocks using single piece cylinder housings, commonly referred to as "FIG. 8" cylinders that are used in padlocks and the like.

The invention claimed is:

1. A removable shackle for a padlock with a locking assembly, the shackle having a U-shape with parallel first and second arms, the second arm being longer than the first arm, the second arm having an end and being circular in cross section with a first diameter and having a longitudinal axis extending the length thereof, each arm toward its end having a notch adapted to cooperate with the locking assembly of the padlock for locking the shackle in the padlock, the second arm having a flat area extending between the notch and the end of the arm and an area of reduced diameter near the end of the second arm extending from one side of the flat area to the other side of the flat area around the circumference of the arm; the end of the second arm having a threaded hole; and a circular retainer of the first diameter detachably secured coaxially with the second arm at the end of the second arm, the circular retainer having a nonthreaded hole, a threaded screw passing through the nonthreaded hole of the retainer and received by the threaded hole in the second arm to secure the retainer coaxially with the second arm.

2. The removable shackle according to claim 1 wherein the area of reduced diameter is a semicircular groove.

3. The removable shackle according to claim 1 wherein the retainer has a spring keeper extending axially downward from the retainer.

4. The removable shackle according to claim 3 wherein the bottom of the spring keeper has a recess adapted to receive the head of the threaded screw.

5. The removable shackle according to claim 1 wherein the threaded screw has a head with a socket to receive a driver to rotate the screw.

6. The padlock according to claim 5 wherein the socket is an Allen hexhead socket.

7. The padlock according to claim 5 wherein the socket is a square drive socket.

8. The padlock according to claim 5 wherein the socket is a torxhead socket.

9. An improved padlock with a removable shackle retainer assembly comprising:

a lock body with first and second bores extending inwardly from the top of the body;

a central cavity open to the bottom of the body and in communication with the first and second bores;

a hole open to the bottom of the body and in communication with the second bore, the hole adapted to receive a socket driver;

a shackle having a U-shape with first and second parallel arms, the first arm adapted to be received in and lockable in the first bore, the second arm adapted to be received in, lockable in, slidable in and out of, and rotatable in the second bore; the end of the second arm having a threaded hole at its end coaxial with the second arm;

a circular retainer having a diameter equal to the diameter of the second arm; the retainer has a nonthreaded hole and a threaded screw adapted to be received through the nonthreaded hole in the retainer and screwed in the threaded hole to secure the retainer to the end of the second arm and coaxially therewith;

a locking assembly in the central cavity adapted to lock the first and second arms in the bores; and a key cylinder assembly attachably connected to the locking assembly and adapted to actuate the locking assembly to lock the lock and to unlock the lock.

10. The padlock according to claim 9 including a compression spring positioned at the bottom of the second bore beneath the end of the second arm.

11. The padlock according to claim 10 wherein the retainer has a spring keeper extending downward adapted to engage the upper end of the spring.

12. The padlock according to claim 11 wherein the retainer spring keeper has a coaxial recess to receive the head of the threaded screw.

13. The padlock according to claim 9 wherein the threaded screw has a head with a socket to receive a driver to rotate the screw.

14. The padlock according to claim 13 wherein the socket is an Allen hexhead socket.

15. The padlock according to claim 13 wherein the socket is a square drive socket.

16. The padlock according to claim 13 wherein the socket is a torxhead socket.

* * * * *